US011111450B2

(12) United States Patent
Liang et al.

(10) Patent No.: US 11,111,450 B2
(45) Date of Patent: Sep. 7, 2021

(54) BASE OIL AND LUBRICANT OIL COMPOSITION INCLUDING THE SAME

(71) Applicant: PATECH FINE CHEMICALS CO., LTD., Taipei (TW)

(72) Inventors: Wei-Chieh Liang, Xianxi Township, Changhua County (TW); Yen-Hsing Li, Xianxi Township, Changhua County (TW); Hsu-Hua Tang, Xianxi Township, Changhua County (TW); Jung-Tsung Hung, Xianxi Township, Changhua County (TW); Jeng-Shiang Tsaih, Xianxi Township, Changhua County (TW)

(73) Assignee: Patech Fine Chemicals Co., Ltd., Taipei (TW)

( * ) Notice: Subject to any disclaimer, the term of this patent is extended or adjusted under 35 U.S.C. 154(b) by 0 days.

(21) Appl. No.: 16/676,680

(22) Filed: Nov. 7, 2019

(65) Prior Publication Data

US 2020/0148966 A1 May 14, 2020

(30) Foreign Application Priority Data

Nov. 9, 2018 (TW) ..... 107139891

(51) Int. Cl.

| | |
|---|---|
| ***C10M 105/42*** | (2006.01) |
| ***C10M 105/34*** | (2006.01) |
| ***C10M 105/12*** | (2006.01) |
| *C10N 30/02* | (2006.01) |
| *C10N 30/06* | (2006.01) |

(52) U.S. Cl.

CPC ..... *C10M 105/34* (2013.01); *C10M 105/12* (2013.01); *C10M 105/42* (2013.01); *C10M 2207/0215* (2013.01); *C10M 2207/103* (2013.01); *C10M 2207/28* (2013.01); *C10M 2207/2815* (2013.01); *C10M 2207/30* (2013.01); *C10N 2030/02* (2013.01); *C10N 2030/06* (2013.01)

(58) Field of Classification Search

CPC ..... C10M 105/34; C10M 105/12; C10M 2207/0215; C10M 2207/103; C10M 2207/2815; C10M 169/042; C10M 105/42; C10M 2207/28; C10M 2207/30; C10N 2030/02; C10N 2030/06; C10N 2020/01; C10N 2020/02

See application file for complete search history.

(56) References Cited

U.S. PATENT DOCUMENTS

| | | | | |
|---|---|---|---|---|
| 2011/0160109 | A1* | 6/2011 | Ruhr | C10M 173/025 508/428 |
| 2012/0053097 | A1* | 3/2012 | Tagawa | C10M 107/02 508/272 |
| 2013/0234754 | A1 | 9/2013 | Arsovski et al. | |

FOREIGN PATENT DOCUMENTS

| | | |
|---|---|---|
| EP | 1 225 213 | 7/2002 |
| EP | 2 268 778 | 1/2011 |
| JP | 2014-189555 | 10/2014 |
| JP | 6191188 B2 | 9/2017 |
| TW | 201439298 A | 10/2014 |
| WO | 2000/068345 | 11/2000 |
| WO | 2009/130445 | 10/2009 |
| WO | WO 2009/130445 | 10/2009 |

OTHER PUBLICATIONS

Search Report appended to an Office Action, which was issued to Taiwanese counterpart application No. 107139891 by the TIPO dated Mar. 19, 2019, with an English translation thereof.

Search Report issued in EP Appln. No. 19207726.1 dated Apr. 24, 2020.

Search Report issued in European counterpart application No. 19207726.1 by the EPO dated Apr. 24, 2020. 6 pages.

* cited by examiner

*Primary Examiner* — Taiwo Oladapo

(74) *Attorney, Agent, or Firm* — Nixon & Vanderhye PC

(57) ABSTRACT

A base oil includes an ester compound obtained by reacting a fatty acid component and a monohydric alcohol component. The fatty acid component includes a $C_4$-$C_{28}$ fatty acid. The monohydric alcohol component includes at least one $C_4$-$C_{22}$ straight chain monohydric alcohol and at least one $C_4$-$C_{22}$ branched chain monohydric alcohol. A lubricant oil composition including the base oil is also disclosed.

12 Claims, No Drawings

BASE OIL AND LUBRICANT OIL COMPOSITION INCLUDING THE SAME

CROSS-REFERENCE TO RELATED APPLICATION

This application claims priority of Taiwanese Patent Application No. 107139891, filed on Nov. 9, 2018.

FIELD

The present disclosure relates to a base oil and a lubricant oil composition including the base oil.

BACKGROUND

In order to obtain a lubricant oil composition having a reduced viscosity, it is necessary to prepare a base oil contained therein having a lower viscosity as possible. It is known that the viscosity of the base oil depends on the molecular weight thereof, i.e., the lower the molecular weight, the lower the viscosity. However, the base oil with a low molecular weight would normally have a relatively low flash point and a relatively high volatility, rendering the base oil a potential safety hazard which might cause deterioration of working environment. In addition, reducing the molecular weight of the base oil would reduce an extreme pressure thereof, causing difficulty in forming an oil film having a desired thickness on a surface of a workpiece. Thus, the workpiece may easily lose lubricity during processing, which results in damage thereon. Furthermore, if the base oil has a high pour point, additional heating equipment is required to maintain fluidity of the lubricant oil composition in a cold environment.

Japanese Invention Patent Publication No. JP 6191188 B2 discloses a base oil including an ester compound that is prepared from oleic acid and only a branched tridecyl alcohol. However, the branched-chain structure of the tridecyl alcohol on the resultant ester compound makes it difficult to adhere to a surface of a workpiece for forming an oil film. That is, the base oil obtained in this patent has a low extreme pressure, and thus fails to meet current industrial requirements. On the other hands, base oils including ester compounds that are prepared from straight-chain alcohols (i.e., the ester compounds having a fully linear structure) are available, but such base oils have a high pour point, and thus are also incompatible with current industrial requirements.

U.S. Patent Application Publication No. US 2013/0234754 A1 discloses base oils including fatty acid ester which can be prepared from fatty acids and at least one branched or unbranched monoalcohol. However, among the various base oils disclosed in this application, none of them meets industrial requirements of low viscosity, high flash point, low pour point and high extreme pressure.

In view of the abovementioned shortcomings of conventional base oils, there is a need for those skilled in the art to develop a base oil having desirable properties, i.e., low viscosity, high flash point, low pour point and high extreme pressure, so as to meet industrial requirements.

SUMMARY

Therefore, an object of the present disclosure is to provide a base oil that can alleviate at least one of the drawbacks of the prior art.

According to the present disclosure, the base oil includes an ester compound obtained by reacting a fatty acid component and a monohydric alcohol component. The fatty acid component includes a $C_4$-$C_{28}$ fatty acid. The monohydric alcohol component includes at least one $C_4$-$C_{22}$ straight chain monohydric alcohol and at least one $C_4$-$C_{22}$ branched chain monohydric alcohol.

Another object of the present disclosure is to provide a lubricant oil composition that can alleviate at least one of the drawbacks of the prior art.

According to the present disclosure, the lubricant oil composition includes the abovementioned base oil.

DETAILED DESCRIPTION

It is to be understood that, if any prior art publication is referred to herein, such reference does not constitute an admission that the publication forms a part of the common general knowledge in the art, in Taiwan or any other country.

For the purpose of this specification, it will be clearly understood that the word "comprising" means "including but not limited to", and that the word "comprises" has a corresponding meaning.

Unless otherwise defined, all technical and scientific terms used herein have the meaning commonly understood by a person skilled in the art to which this disclosure belongs. One skilled in the art will recognize many methods and materials similar or equivalent to those described herein, which could be used in the practice of this disclosure. Indeed, this disclosure is in no way limited to the methods and materials described.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some aspects, ±100% in some aspects ±50%, in some aspects ±20%, in some aspects ±10%, in some aspects ±5%, in some aspects ±1%, in some aspects ±0.5%, and in some aspects ±0.1% from the specified amount, as such variations are appropriate to perform the disclosed methods or employ the disclosed components/compositions.

The present disclosure provides a base oil including an ester compound, which is obtained by reacting a fatty acid component and a monohydric alcohol component, i.e., an esterification reaction.

In certain embodiments, the esterification reaction is conducted at a temperature that ranges from 150° C. to 250°

C. In other embodiments, the esterification reaction is conducted at a temperature that ranges from 180° C. to 240° C. In yet other embodiments, the esterification reaction is conducted at a temperature that ranges from 200° C. to 230° C.

The esterification reaction may be conducted in the presence of a catalyst. Any catalyst that is capable of promoting the esterification reaction of fatty acid and monohydric alcohol may be applied in the present disclosure. Examples of the catalyst may include, but are not limited to, stannous oxalate, stannous oxide, tetrabutyl titanate, titanium tetraisopropanolate, methanesulfonic acid, and combinations thereof.

In certain embodiments, after the esterification reaction, a purification treatment is further conducted to remove water, catalyst and/or impurities from the resultant reaction product, so as to obtain the ester compound.

In certain embodiments, the base oil has a hydroxyl value that is not greater than 5 mg KOH/g. In other embodiments, the base oil has a hydroxyl value that is not greater than 3 mg KOH/g. In yet other embodiments, the base oil has a hydroxyl value that is not greater than 1 mg KOH/g.

In certain embodiments, the base oil has an acid value that is not greater than 1.0 mg KOH/g. In other embodiments, the base oil has an acid value that is not greater than 0.5 mg KOH/g. In yet other embodiments, the base oil has an acid value that is not greater than 0.1 mg KOH/g.

It should be noted that, the ratio of the fatty acid component to the monohydric alcohol component applied in the esterification reaction may be adjusted according to the hydroxyl value and/or the acid value of the base oil to be obtained.

In certain embodiments, the base oil has a kinematic viscosity at 40° C. that is not greater than 15 cSt, as determined according to ASTM D445. In other embodiments, the base oil has a kinematic viscosity at 40° C. that is not greater than 14 cSt, as determined according to ASTM D445.

In certain embodiments, the base oil has a flash point that is not lower than 250° C., as determined according to ASTM D92.

In certain embodiments, the base oil has a pour point that is not higher than 0° C., as determined according to ASTM D97.

In certain embodiments, the base oil has an extreme pressure that is greater than 1200 lbs, as determined according to ASTM D3233.

According to the present disclosure, for obtaining the ester compound of the base oil, the fatty acid component includes a $C_4$-$C_{28}$ fatty acid. The $C_4$-$C_{28}$ fatty acid may be saturated, mono-unsaturated or poly-unsaturated, and may be straight chain (unbranched) or branched chain. Examples of the $C_4$-$C_{28}$ fatty acid suitable for use in the present disclosure may include, but are not limited to, butyric acid (C4), caproic acid (C6), caprylic acid (C8), capric acid (C10), lauric acid (C12), tridecylic acid (C13), myristic acid (C14), pentadecylic acid (C15), palmitic acid (C16), palmitoleic acid (C16), margaric acid (C17), stearic acid (C18), isostearic acid (C18), oleic acid (C18), vaccenic acid (C18), linoleic acid (C18), alpha-linolenic acid (C18), gamma-linolenic acid (C18), nonadecylic acid (C19), arachidic acid (C20), gadoleic acid (C20), arachidonic acid (C20), eicosapentaenoic acid (C20), heneicosylic acid (C21), behenic acid (C22), erucic acid (C22), docosahexaenoic acid (C22), lignoceric acid (C24), and combinations thereof.

In an exemplary embodiment, the fatty acid component includes a $C_{18}$ saturated fatty acid and/or a $C_{18}$ unsaturated fatty acid.

In certain embodiments, the $C_{18}$ saturated fatty acid and/or the $C_{18}$ unsaturated fatty acid are together present in an amount that is not less than 50 wt % based on 100 wt % of the fatty acid component, such that the base oil thus obtained has a relatively higher flash point and a relatively lower pour point. In other embodiments, based on 100 wt % of the fatty acid component, the $C_{18}$ saturated fatty acid and/or, the $C_{18}$ unsaturated fatty acid are together present in an amount that is not less than 70 wt %.

According to the present disclosure, for obtaining the ester compound of the base oil, the monohydric alcohol component includes at least one $C_4$-$C_{22}$ straight chain monohydric alcohol and at least one $C_4$-$C_{22}$ branched chain monohydric alcohol. The monohydric alcohol may be saturated, mono-unsaturated or poly-unsaturated.

In certain embodiments, the $C_4$-$C_{22}$ branched chain monohydric alcohol is present in an amount that is not less than 40 wt % based on 100 wt % of the monohydric alcohol component. In other embodiments, the $C_4$-$C_{22}$ branched chain monohydric alcohol is present in an amount that is not less than 45 wt % based on 100 wt % of the monohydric alcohol component.

Examples of the $C_4$-$C_{22}$ straight chain monohydric alcohol may include, but are not limited to, a $C_4$-$C_{11}$ straight chain monohydric alcohol, a $C_{12}$-$C_{15}$ straight chain monohydric alcohol (e.g., a $C_{12}$-$C_{13}$ straight chain monohydric alcohol, and a $C_{14}$-$C_{15}$ straight chain monohydric alcohol), a $C_{16}$-$C_{22}$ straight chain monohydric alcohol, and combinations thereof. In certain embodiments, the $C_4$-$C_{22}$ straight chain monohydric alcohol is a $C_9$-$C_{17}$ straight chain monohydric alcohol. In an exemplary embodiment, the $C_4$-$C_{22}$ straight chain monohydric alcohol is a $C_9$-$C_{17}$ saturated straight chain monohydric alcohol.

Examples of the $C_4$-$C_{22}$ branched chain monohydric alcohol may include, but are not limited to, a $C_4$-$C_{11}$ branched chain monohydric alcohol, a $C_{12}$-$C_{15}$ branched chain monohydric alcohol (e.g., a $C_{12}$-$C_{13}$ branched chain monohydric alcohol and a $C_{14}$-$C_{15}$ branched chain monohydric alcohol), a $C_{16}$-$C_{22}$ branched chain monohydric alcohol, combinations thereof. In certain embodiments, the $C_4$-$C_{22}$ branched chain monohydric alcohol is a $C_3$-$C_{17}$ branched chain monohydric alcohol. In an exemplary embodiment, the $C_4$-$C_{22}$ branched chain monohydric alcohol is a $C_9$-$C_{17}$ saturated branched chain monohydric alcohol.

In certain embodiments, among the at least one $C_4$-$C_{22}$ straight chain monohydric alcohol and the at least one $C_4$-$C_{22}$ branched chain monohydric alcohol, at least one monohydric alcohol has 12 to 15 carbon atoms. That is, the at least one monohydric alcohol having 12 to 15 carbon atoms is selected from at least one $C_{12}$-$C_{15}$ straight chain monohydric alcohol, at least one $C_{12}$-$C_{15}$ branched chain monohydric alcohol, and a combination thereof.

In certain embodiments, the at least one monohydric alcohol having 12 to 15 carbon atoms is present in an amount that ranges from 90.0 wt % to 99.8 wt % based on 100 wt % of the monohydric alcohol component. In other embodiments, the at least one monohydric alcohol having 12 to 15 carbon atoms is present in an amount that ranges from 94.0 wt % to 99.8 wt % based on 100 wt % of the monohydric alcohol component.

In certain embodiments, among the at least one $C_4$-$C_{22}$ straight chain monohydric alcohol and the at least one $C_4$-$C_{22}$ branched chain monohydric alcohol, at least one monohydric alcohol has 12 and 13 carbon atoms and at least one monohydric alcohol has 14 to 15 carbon atoms. That is, the at least one monohydric alcohol having 12 and 13 carbon atoms is selected from at least one $C_{12}$-$C_{13}$ straight chain monohydric alcohol, at least one $C_{12}$-$C_{13}$ branched chain monohydric alcohol, and a combination thereof; and the at least one monohydric alcohol having 14 and 15 carbon atoms is selected from at least one $C_{14}$-$C_{15}$ straight chain monohydric alcohol, at least one $C_{14}$-$C_{15}$ branched chain monohydric alcohol, and a combination thereof.

In certain embodiments, based on 100 wt % of the monohydric alcohol component, the at least one monohydric alcohol having 12 to 13 carbon atoms is present in an amount ranging from 10 wt % to 70 wt % and the at least one monohydric alcohol having 14 to 15 carbon atoms is present in an amount ranging from 10 wt % to 70 wt %. In other embodiments, based on 100 wt % of the monohydric alcohol component, the at least one monohydric alcohol having 12 to 13 carbon atoms is present in an amount ranging from 30 wt % to 60 wt % and the at least one monohydric alcohol having 14 to 15 carbon atoms is present in an amount ranging from 30 wt % to 60 wt %.

In certain embodiments, among the at least one $C_4$-$C_{22}$ straight chain monohydric alcohol and the at least one $C_4$-$C_{22}$ branched chain monohydric alcohol, at least one monohydric alcohol has 4 to 11 carbon atoms. That is, the at least one monohydric alcohol having 4 to 11 carbon atoms is selected from at least one $C_4$-$C_{11}$ straight chain monohydric alcohol, at least one $C_4$-$C_{11}$ branched chain monohydric alcohol, and a combination thereof.

In certain embodiments, the at least one monohydric alcohol having 4 to 11 carbon atoms is present in an amount that ranges from 0.1 wt % to 5.0 wt % based on 100 wt % of the monohydric alcohol component. In other embodiments, the at least one monohydric alcohol having 4 to 11 carbon atoms is present in an amount that ranges from 0.1 wt % to 1.0 wt % based on 100 wt % of the monohydric alcohol component.

In certain embodiments, among the at least one $C_4$-$C_{22}$ straight chain monohydric alcohol and the at least one $C_4$-$C_{22}$ branched chain monohydric alcohol, at least one monohydric alcohol has 16 to 22 carbon atoms. That is, the at least one monohydric alcohol having 16 to 22 carbon atoms is selected from at least one $C_{16}$-$C_{22}$ straight chain monohydric alcohol, at least one $C_{16}$-$C_{22}$ branched chain monohydric alcohol, and a combination thereof.

In certain embodiments, the at least one monohydric alcohol having 16 to 22 carbon atoms is present in an amount that ranges from 0.1 wt % to 5.0 wt % based on 100 wt % of the monohydric alcohol component. In other embodiments, the at least one monohydric alcohol having 16 to 22 carbon atoms is present in an amount that ranges from 0.1 wt % to 1.0 wt % based on 100 wt % of the monohydric alcohol component.

In certain embodiments, among the at least one $C_4$-$C_{22}$ straight chain monohydric alcohol and the at least one $C_4$-$C_{22}$ branched chain monohydric alcohol, at least one monohydric alcohol has 4 to 11 carbon atoms from, at least one monohydric alcohol has 12 to 15 carbon atoms, and at least one monohydric alcohol has 16 to 22 carbon atoms. The at least one monohydric alcohol having 4 to 11 carbon atoms is selected from at least one $C_4$-$C_{11}$ straight chain monohydric alcohol, at least one $C_4$-$C_{11}$ branched chain monohydric alcohol, and a combination thereof. The at least one monohydric alcohol having 12 to 15 carbon atoms is selected from at least one $C_{12}$-$C_{15}$ straight chain monohydric alcohol, at least one $C_{12}$-$C_{15}$ branched chain monohydric alcohol, and a combination thereof. The at least one monohydric alcohol having 16 to 22 carbon atoms is selected from at least one $C_{16}$-$C_{22}$ straight chain monohydric alcohol, at least one $C_{16}$-$C_{22}$ branched chain monohydric alcohol, and a combination thereof. That is, the monohydric alcohol component includes at least three monohydric alcohols having the specified numbers of carbon atoms as mentioned above, at least one of which is straight chain and at least one of which is branched chain.

In certain embodiments, among the at least one $C_4$-$C_{22}$ straight chain monohydric alcohol and the at least one $C_4$-$C_{22}$ branched chain monohydric alcohol, at least one monohydric alcohol has 4 to 11 carbon atoms, at least one monohydric alcohol has 12 to 13 carbon atoms, at least one monohydric alcohol has 14 to 15 carbon atoms, and at least one monohydric alcohol has 16 to 22 carbon atoms. The at least one monohydric alcohol having 4 to 11 carbon atoms is selected from at least one $C_4$-$C_{11}$ straight chain monohydric alcohol, at least one $C_4$-$C_{11}$ branched chain monohydric alcohol, and a combination thereof. The at least one monohydric alcohol having 12 to 13 carbon atoms is selected from at least one $C_{12}$-$C_{13}$ straight chain monohydric alcohol, at least one $C_{12}$-$C_{13}$ branched chain monohydric alcohol, and a combination thereof. The at least one monohydric alcohol having 14 to 15 carbon atoms is selected from at least one $C_{14}$-$C_{15}$ straight chain monohydric alcohol, at least one $C_{14}$-$C_{15}$ branched chain monohydric alcohol, and a combination thereof. The at least one monohydric alcohol having 16 to 22 carbon atoms is selected from at least one $C_{16}$-$C_{22}$ straight chain monohydric alcohol, at least one $C_{16}$-$C_{22}$ branched chain monohydric alcohol, and a combination thereof. That is, the monohydric alcohol component includes at least four monohydric alcohols having the specified numbers of carbon atoms as mentioned above, at least one of which is straight chain and at least one of which is branched chain.

In certain embodiments, among the at least one $C_4$-$C_{22}$ straight chain monohydric alcohol and the at least one $C_4$-$C_{22}$ branched chain monohydric alcohol, at least one monohydric alcohol has 4 to 11 carbon atoms, at least one monohydric alcohol has 12 carbon atoms, at least one monohydric alcohol has 13 carbon atoms, at least one monohydric alcohol has 14 carbon atoms, at least one monohydric alcohol has 15 carbon atoms, and at least one monohydric alcohol has 16 to 22 carbon atoms. The at least one monohydric alcohol having 4 to 11 carbon atoms is selected from at least one $C_4$-$C_{11}$ straight chain monohydric alcohol, at least one $C_4$-$C_{11}$ branched chain monohydric alcohol, and a combination thereof. The at least one monohydric alcohol having 12 carbon atoms is selected from at least one $C_{12}$ straight chain monohydric alcohol, at least one $C_{12}$ branched chain monohydric alcohol, and a combination thereof. The at least one monohydric alcohol having 13 carbon atoms is selected from at least one $C_{13}$ straight chain monohydric alcohol, at least one $C_{13}$ branched chain monohydric alcohol, and a combination thereof. The at least one monohydric alcohol having 14 carbon atoms is selected from at least one $C_{14}$ straight chain monohydric alcohol, at least one $C_{14}$ branched chain monohydric alcohol, and a combination thereof. The at least one monohydric alcohol having 15 carbon atoms is selected from at least one $C_{15}$ straight chain monohydric alcohol, at least one $C_{15}$ branched chain monohydric alcohol, and a combination thereof. The at least one monohydric alcohol having 16 to 22 carbon atoms is selected from at least one $C_{16}$-$C_{22}$ straight chain monohydric alcohol, at least one $C_{16}$-$C_{22}$ branched chain monohydric alcohol, and a combination thereof. That is, the monohydric alcohol component includes at least six monohydric alcohols having the specified numbers of carbon atoms as mentioned above, at least one of which is straight chain and at least one of which is branched chain.

In certain embodiments, based on 100 wt % of the monohydric alcohol component, the at least one monohydric alcohol having 4 to 11 carbon atoms is present in an amount ranging from 0.3 wt to 0.7 wt %, the at least one monohydric alcohol having 12 carbon atoms is present in an amount ranging from 15 wt % to 25 wt %, the at least one monohydric alcohol having 13 carbon atoms is present in an amount ranging from 25 wt % to 35 wt %, the at least one monohydric alcohol having 14 carbon atoms is present in an amount ranging from 25 wt % to 35 wt %, the at least one monohydric alcohol having 15 carbon atoms is present in an amount ranging from 14 wt % to 23 wt %, and the at least one monohydric alcohol having 16 to 22 carbon atoms is present in an amount ranging from 0.3 wt % to 0.7 wt %.

The present disclosure also provides a lubricant oil composition that includes the abovementioned base oil.

The lubricant oil composition may further include an additive. Examples of the additive may include, but are not limited to, aminic antioxidant (e.g., IRGANOX® L57 available from Ciba Specialty Chemicals), tricresyl phosphate, chlorinated paraffin, and combinations thereof.

The lubricant oil composition of this disclosure is suitable to be used in various applications, particularly as a lubricant oil for metal.

The present disclosure will be further described by way of the following examples. However, it should be understood that the following examples are intended solely for the purpose of illustration and should not be construed as limiting the disclosure in practice.

EXAMPLES

Preparation of Base Oil

Example 1 (E1)

A fatty acid component and a monohydric alcohol component as shown in Table 1 were subjected to an esterification reaction at a temperature ranging from 200° C. to 230° C. in the presence of a catalyst (i.e., stannous oxalate) having a concentration 400 ppm, so as to obtain a reaction product that includes an ester compound having a hydroxyl value of less than 1 mg KOH/g. The hydroxyl value was determined using 0.05 N potassium hydroxide as the titrant according to the procedures set forth in ASTM D974.

The reaction product was then subjected to a purification treatment, which was conducted according to the procedures as described below. First, the reaction product was dried under a high vacuum to reduce the water amount thereof to less than 0.1 wt %. The dried product thus obtained was then subjected to distillation following addition of potassium hydroxide, until the acid value thereof is reduced to 0.01 mg KOH/g. Finally, filtration using activated carbon and perlite as filtering agents was conducted to remove the catalyst and impurities, thereby obtaining a base oil including the ester compound. The acid value as mentioned above was determined using 0.05 N potassium hydroxide as the titrant according to the procedures set forth in ASTM D974, and the water amount was determined using coulometric Karl Fischer moisture titrator according to the procedures set forth in ASTM E1064.

Comparative Examples 1 to 6 (CE1-6)

Each of the base oils of Comparative Examples 1 to 6 was prepared by a method similar to that for Example 1, except for the fatty acid component and/or the monohydric alcohol component used therein, which are shown in Table 1 in detail. The ratio of the fatty acid component to the monohydric alcohol component in each example was adjusted according to the hydroxyl value of the thus obtained reaction product.

TABLE 1

| Examples | Fatty acid component | Monohydric alcohol component |
|---|---|---|
| E1 | Oleic acid[1] | $C_9$-$C_{17}$ saturated straight chain monohydric alcohols and $C_9$-$C_{17}$ saturated branched chain monohydric alcohols[3] |
| CE1 | Oleic acid[1] | Saturated isotridecyl alcohol |
| CE2 | Oleic acid[1] | 1-dodecanol and 1-Tridecanol |
| CE3 | Oleic acid[1] | 2-ethylhexanol |
| CE4 | Stearic acid[2] | 2-ethylhexanol |
| CE5 | Oleic acid[1] | Isocetyl alcohol |
| CE6 | Oleic acid[1] | $C_9$-$C_{17}$ saturated branched chain monohydric alcohols[4] |

[1]PALMERA ® A1813 available from KLK OLEO, Malaysia

[2]SA-1865 available from Natural Oleochemicals, Malaysia

[3]based on 100 wt % of the monohydric alcohol component, the $C_9$-$C_{17}$ saturated straight chain and branched chain monohydric alcohols in E1 are composed of the following saturated monohydric alcohols (a) to (f), and the $C_9$-$C_{17}$ saturated branched chain monohydric alcohols are present in an amount that is not less than 45 wt %:
(a) $C_9$-$C_{11}$ straight chain and/or branched chain monohydric alcohols that are together present in an amount of 0.5 wt %;
(b) $C_{12}$ straight chain and/or branched chain monohydric alcohols that are together present in an amount of 20 wt %;
(c) $C_{13}$ straight chain and/or branched chain monohydric alcohols that are together present in an amount of 30 wt %;
(d) $C_{14}$ straight chain and/or branched chain monohydric alcohols that are together present in an amount of 30 wt %;
(e) $C_{15}$ straight chain and/or branched chain monohydric alcohol that are together present in an amount of 19 wt %; and
(f) $C_{16}$-$C_{17}$ straight chain and/or branched chain monohydric alcohol that are present in an amount of 0.5 wt %.

[4]the $C_9$-$C_{17}$ saturated branched chain monohydric alcohols in CE6 are composed of the following saturated branched monohydric alcohols (a) to (d):
(a) $C_9$-$C_{11}$ branched chain monohydric alcohols that are present in an amount of ≤1 wt %;
(b) $C_{12}$-$C_{13}$ branched chain monohydric alcohols that are present in an amount of 35 wt % to 65 wt %;
(c) $C_{14}$-$C_{15}$ branched chain monohydric alcohols that are present in an amount of 35 wt % to 65 wt %; and
(d) $C_{16}$-$C_{17}$ branched chain monohydric alcohols that are present in an amount of ≤2 wt %.

Property Evaluation for Base Oil

A. Determination of Kinematic Viscosity and Calculation of Viscosity Index

The kinematic viscosity of the base oil for each example (i.e., E1 and CE1 to CE6) was measured both at 40° C. and 100° C. according to the procedures set forth in ASTM D445. The viscosity index of the base oil for each example was then calculated based on the kinematic viscosity measured at 40° C. and 100° C. It should be noted that, the kinematic viscosity at 40° C. of the base oil should be not greater than 15 cSt, so as to meet the low viscosity requirement of the present disclosure.

B. Determination of Flash Point

The flash point of the base oil for each example was measured using Cleveland open cup apparatus according to the procedures set forth in ASTM D92. It should be noted that, the flash point of the base oil should be not lower than 250° C., so as to meet the high flash point requirement of the present disclosure.

C. Determination of Pour Point

The pour point of the base oil of each example was measured according to the procedures set forth in ASTM D97. It should be noted that, the pour point of the base oil should be not higher than 0° C., so as to meet the low pour point requirement of the present disclosure.

D. Determination of Extreme Pressure

The extreme pressure of the base oil of each of E1, CE1, CE4 and CE6 was measured according to the procedures set forth in ASTM D3233. Specifically, a steel pin (Falex) was rotated at 290±10 rpm against two stationary vee blocks that were immersed in the base oil. A load applied via a ratchet mechanism to generate torque was steadily increased until seizure occurred, the ratchet mechanism failed to increase the load, or the rotating steel pin broke. The thus recorded values of torque (lbs) were determined to be the capability of the base oil to lubricate under extreme pressures. The evaluated properties of the base oil of each example are shown in Table 2.

TABLE 2

| Examples | Kinematic viscosity at 40° C. (cSt) | Kinematic viscosity at 100° C. (cSt) | Viscosity index | Flash point (° C.) | Pour point (° C.) | Extreme pressure (lbs) |
|---|---|---|---|---|---|---|
| E1 | 13.7 | 3.9 | 198 | 262 | −9 | 1450 |
| CE1 | 14.2 | 3.9 | 182 | 258 | −30 | 1200 |
| CE2 | 14.1 | 4.0 | 197 | 248 | 6 | — |
| CE3 | 8.4 | 2.7 | 187 | 220 | −27 | — |
| CE4 | 9.7 | 2.9 | 167 | 224 | 6 | 800 |
| CE5 | 15.3 | 4.1 | 182 | 266 | −45 | — |
| CE6 | 13.4 | 3.8 | 196 | 262 | −30 | 1200 |

As shown in Table 2, the kinematic viscosity at 40° C. of the base oil of CE5 was greater than 15 cSt, indicating that it fails to meet the low viscosity requirement of the present disclosure. In contrast, the kinematic viscosity at 40° C. of the base oil of E1 was lower than 15 cSt.

Regarding the flash point, the base oil of each of CE2 to CE4 has the flash point lower than 250° C., indicating that CE2 to CE4 fail to meet the high flash point requirement of the present disclosure. In contrast, the flash point of the base oil of E1 was higher than 250° C.

As to the pour point, the base oils of CE2 and CE4 have the pour point higher than 0° C., indicating that CE2 and CE4 fail to meet the low pour point requirement of the present disclosure. In contrast, the pour point of the base oil of EG was lower than 0° C.

Although the base oils of CE1 and CE6 have low viscosities, high flash points and low pour points, the extreme pressure thereof were only 1200 lbs, which was lower than that of E1 (i.e., 1450 lbs).

Based on the abovementioned results, as compared to the base oils of CE1 to CE6, each of which includes the ester compound obtained by reacting the fatty acid component with only straight chain monohydric alcohol(s) or only branched chain monohydric alcohol(s), the base oil of E1, which includes the ester compound obtained by reacting the fatty acid component with the monohydric alcohol component containing both of the straight chain monohydric alcohols and the branched chain monohydric alcohols, has desirable properties, such as low viscosity (i.e., not greater than 15 cSt), high flash point (i.e., not lower than 250° C.), low pour point (not higher than 0° C.), and high extreme pressure (not greater than 1200 lbs).

In summary, by virtue of including the ester compound obtaining by reacting the fatty acid component with the monohydric alcohol component that includes at least one $C_4$-$C_{22}$ straight chain monohydric alcohol and at least one $C_4$-$C_{22}$ branched chain monohydric alcohol, the base oil of the present disclosure is conferred with desirable properties, such as low viscosity, high flash point, low pour point, and high extreme pressure, so as to meet industrial requirements.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the present disclosure has been described in connection with what is considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A base oil, comprising an ester compound obtained by reacting a fatty acid component and a monohydric alcohol component, wherein said fatty acid component includes a $C_4$-$C_{28}$ fatty acid, wherein said monohydric alcohol component includes at least one $C_4$-$C_{22}$ straight chain monohydric alcohol and at least one $C_4$-$C_{22}$ branched chain monohydric alcohol, a total of said $C_4$-$C_{22}$ straight chain monohydric alcohol and said $C_4$-$C_{22}$ branched chain monohydric alcohol being not less than 3, wherein among the total of said $C_4$-$C_{22}$ straight chain monohydric alcohol and said $C_4$-$C_{22}$ branched chain monohydric alcohol, at least one monohydric alcohol has 4 to 11 carbon atoms, at least one monohydric alcohol has 12 to 15 carbon atoms, and at least one monohydric alcohol has 16 to 22 carbon atoms, wherein said at least one monohydric alcohol having 4 to 11 carbon atoms is present in an amount that ranges from 0.1 wt % to 5.0 wt % based on 100 wt % of said monohydric alcohol component, and wherein said at least one monohydric alcohol having 16 to 22 carbon atoms is present in an amount that ranges from 0.1 wt % to 5.0 wt % based on 100 wt % of said monohydric alcohol component.

2. The base oil as claimed in claim 1, wherein said at least one monohydric alcohol having 12 to 15 carbon atoms is present in an amount that ranges from 90.0 wt % to 99.8 wt % based on 100 wt % of said monohydric alcohol component.

3. The base oil as claimed in claim 1, wherein, among the total of said $C_4$-$C_{22}$ straight chain monohydric alcohol and said $C_4$-$C_{22}$ branched chain monohydric alcohol, at least one monohydric alcohol has 12 to 13 carbon atoms and at least one monohydric alcohol has 14 to 15 carbon atoms.

4. The base oil as claimed in claim 3, wherein, based on 100 wt % of said monohydric alcohol component, said at least one monohydric alcohol having 12 to 13 carbon atoms is present in an amount ranging from 10 wt % to 70 wt % and said at least one monohydric alcohol having 14 to 15 carbon atoms is present in an amount ranging from 10 wt % to 70 wt %.

5. The base oil as claimed in claim 1, wherein said $C_4$-$C_{22}$ branched chain monohydric alcohol is present in an amount that is not less than 40 wt % based on 100 wt % of said monohydric alcohol component.

6. The base oil as claimed in claim 1, wherein said base oil has a hydroxyl value that is not greater than 5 mg KOH/g.

7. The base oil as claimed in claim 1, wherein said base oil has an acid value that is not greater than 1.0 mg KOH/g.

8. The base oil as claimed in claim 1, wherein said base oil has a kinematic viscosity at 40° C. that is not greater than 15 cSt, as determined according to ASTM D445.

9. The base oil as claimed in claim 1, wherein said base oil has a flash point that is not lower than 250° C., as determined according to ASTM D92.

10. The base oil as claimed in claim 1, wherein said base oil has a pour point that is not higher than 0° C., as determined according to ASTM D97.

11. The base oil as claimed in claim 1, wherein said base oil has an extreme pressure that is greater than 1200 lbs, as determined according to ASTM D3233.

12. A lubricant oil composition, comprising said base oil as claimed in claim 1.

* * * * *